US006877452B1

(12) United States Patent
Hudd

(10) Patent No.: US 6,877,452 B1
(45) Date of Patent: Apr. 12, 2005

(54) BOAT CLEANING ASSEMBLY

(76) Inventor: Adrian Gerald Hudd, 5 Waters Edge, Port La Salle, Yarmouth, Isle of Wight P041 OXD (GB)

( * ) Notice: Subject to any disclaimer, the term of this patent is extended or adjusted under 35 U.S.C. 154(b) by 151 days.

(21) Appl. No.: 10/030,754

(22) PCT Filed: Jun. 29, 2000

(86) PCT No.: PCT/GB00/02505

§ 371 (c)(1),
(2), (4) Date: Apr. 19, 2002

(87) PCT Pub. No.: WO01/02243

PCT Pub. Date: Jan. 11, 2001

(30) Foreign Application Priority Data

Jun. 30, 1999 (GB) ..... 9915148

(51) Int. Cl.[7] ..... B63B 59/00
(52) U.S. Cl. ..... 114/222; 15/1.7
(58) Field of Search ..... 114/222; 15/1.7

(56) References Cited

U.S. PATENT DOCUMENTS 1,079,208 A * 11/1913 Browne ..... 114/222
3,561,391 A * 2/1971 Locati ..... 114/222
3,709,184 A * 1/1973 Laney ..... 114/222
4,043,286 A 8/1977 Doty ..... 114/222
4,046,095 A 9/1977 Fike ..... 114/222
4,236,477 A 12/1980 Norris ..... 114/222
4,445,451 A * 5/1984 van den Broek ..... 114/222
4,784,078 A * 11/1988 Feurt ..... 114/222
4,843,995 A * 7/1989 Bingham ..... 114/222

FOREIGN PATENT DOCUMENTS

FR 1 393 901 7/1965
GB 2 022 520 12/1979

* cited by examiner

*Primary Examiner*—Lars A. Olson
(74) *Attorney, Agent, or Firm*—Dergosits & Noah LLP

(57) ABSTRACT

A marine vessel cleaning assembly (1) comprising cleaning means (5, 6) and displacement means **(17*a*, 17*b*) supported on a framework (18) for location under the water, the cleaning means comprising a pair of brushes (5, 6) rotatably mounted on a pair of arms (3, 4) which are pivotable about a submerged axis (A—A). In use the brushes are caused to rotate and contact fouling on the hull of the vessel and are pivoted generally upwardly and downwardly of the hull, the vessel being conveyed with respect to the pivotal axis of the arms (3, 4)** so that the entire hull of the floating vessel may be cleaned. The inventive cleaning assembly advantageously eliminates the significant financial costs associated with arranging for a marine vessel to remain on hard-standing and also reduces the time required to clean the hull of a marine vessel.

16 Claims, 4 Drawing Sheets

BOAT CLEANING ASSEMBLY

The present invention relates to cleaning assemblies and in particular to marine vessel cleaning assemblies.

It is common practice for both power and sailing craft to be cleaned at least twice a year, and where performance and fuel economy are required, these can be increased significantly. However, anti-fouling paints are becoming increasingly expensive and because of world-wide anti-pollution laws the paints available to both the commercial and leisure industries are becoming less effective.

According to a first aspect of the invention there is provided a marine vessel cleaning assembly comprising cleaning means and displacement means supported on a framework adapted for location under the water, the arrangement being such that, in use, the displacement means is operative to urge the cleaning means generally upwardly and downwardly of a hull of a floating marine vessel whilst said cleaning means is in contact with fouling on the hull.

Preferably the displacement means comprises pivot means which is operative to pivot the cleaning means, about a substantially horizontal axis, generally upwardly and downwardly of the hull.

Preferably the cleaning means comprises rotatably mounted brush means which, in use, is caused to rotate.

The assembly desirably comprises sensing means which is operative to monitor a measure of the resistance to the rotation of the brush means.

Preferably the assembly comprises control means which is operative to control the degree of generally upwardly and downwardly directed displacement of the brush means.

The assembly preferably comprises lateral displacement means which is operative to allow generally lateral displacement of the cleaning means with respect to the hull.

Preferably the pivot means is operative to pivot the cleaning means about an axis which is submerged.

The assembly preferably comprises a pair of arms, the cleaning means being mounted on the arms. The cleaning means is preferably located towards one end of each arm. Preferably each arm is pivotable generally upwardly and downwardly of the hull. Preferably each arm is pivotable generally laterally of the hull.

According to a second aspect of the invention there is provided a method of cleaning the hull of a floating marine vessel comprising displacing cleaning means generally upwardly and downwardly of a hull, and arranging that the cleaning means contacts with fouling on the hull.

Preferably the method comprises pivoting the cleaning means generally upwardly, and downwardly of the hull.

The method preferably comprises causing relative translational movement of the hull with respect to the pivotal axis of the cleaning means.

The method desirably comprises causing the cleaning means to rotate.

Preferably the method comprises controlling the degree of generally upwardly and downwardly directed movement of the cleaning means in response to a measure of the resistance to rotation of the cleaning means.

The invention will now be further described by way of example only with reference to the accompanying drawings in which.

Figure 1:
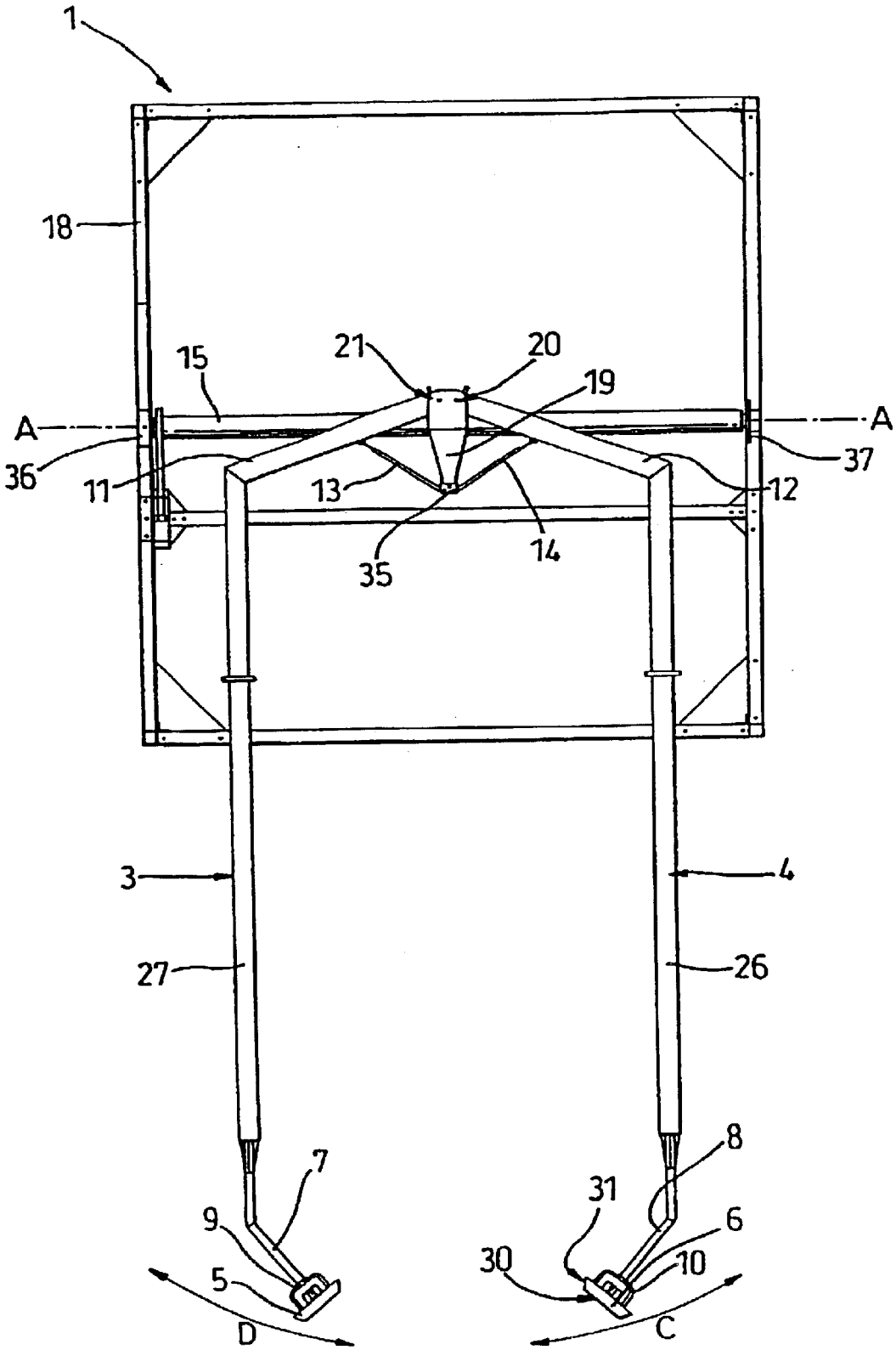
FIG. 1 is a plan view of an assembly in accordance with the invention.
Figure 2:
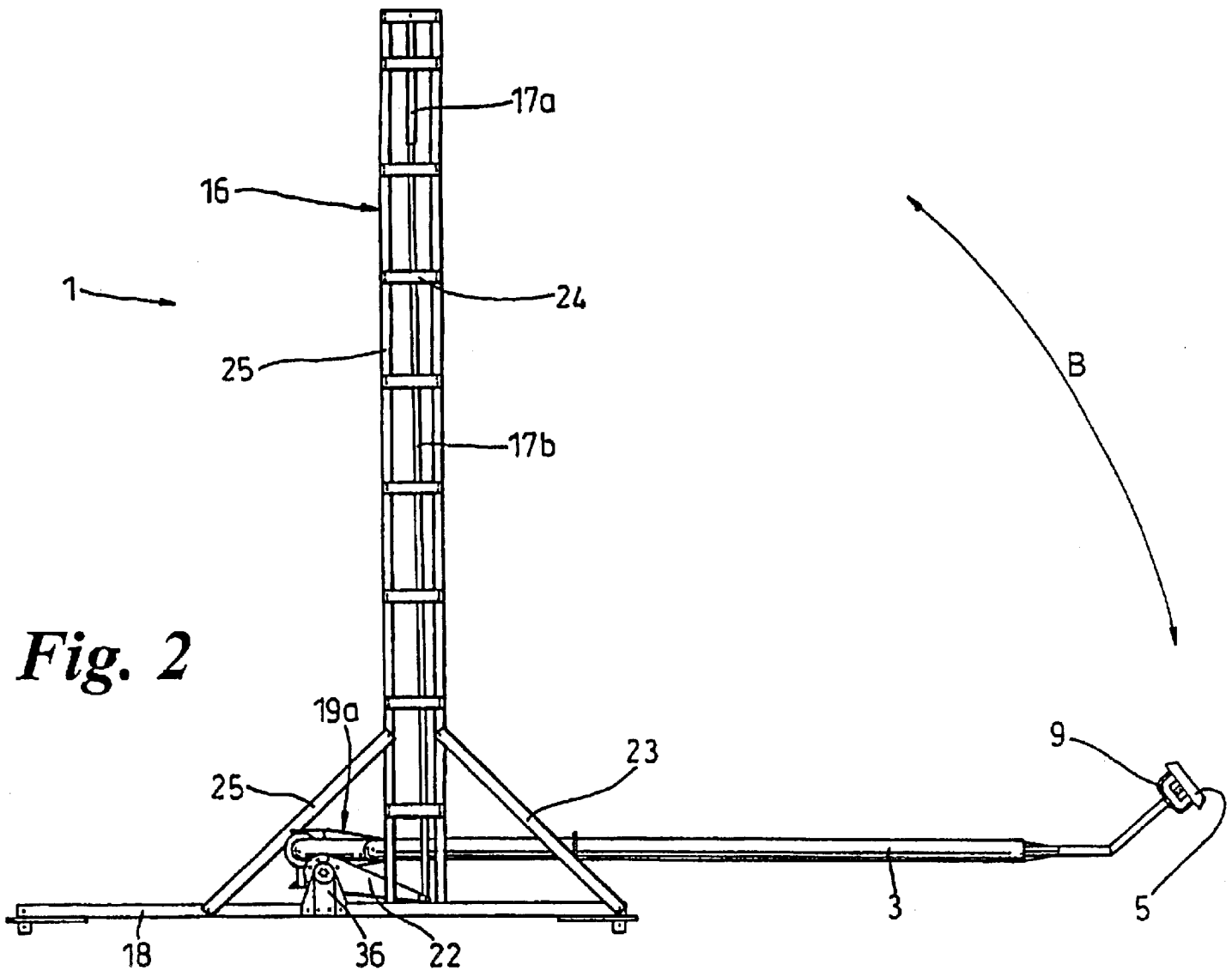
FIG. 2 is a side elevation of the assembly shown in FIG. 1.
Figure 3:
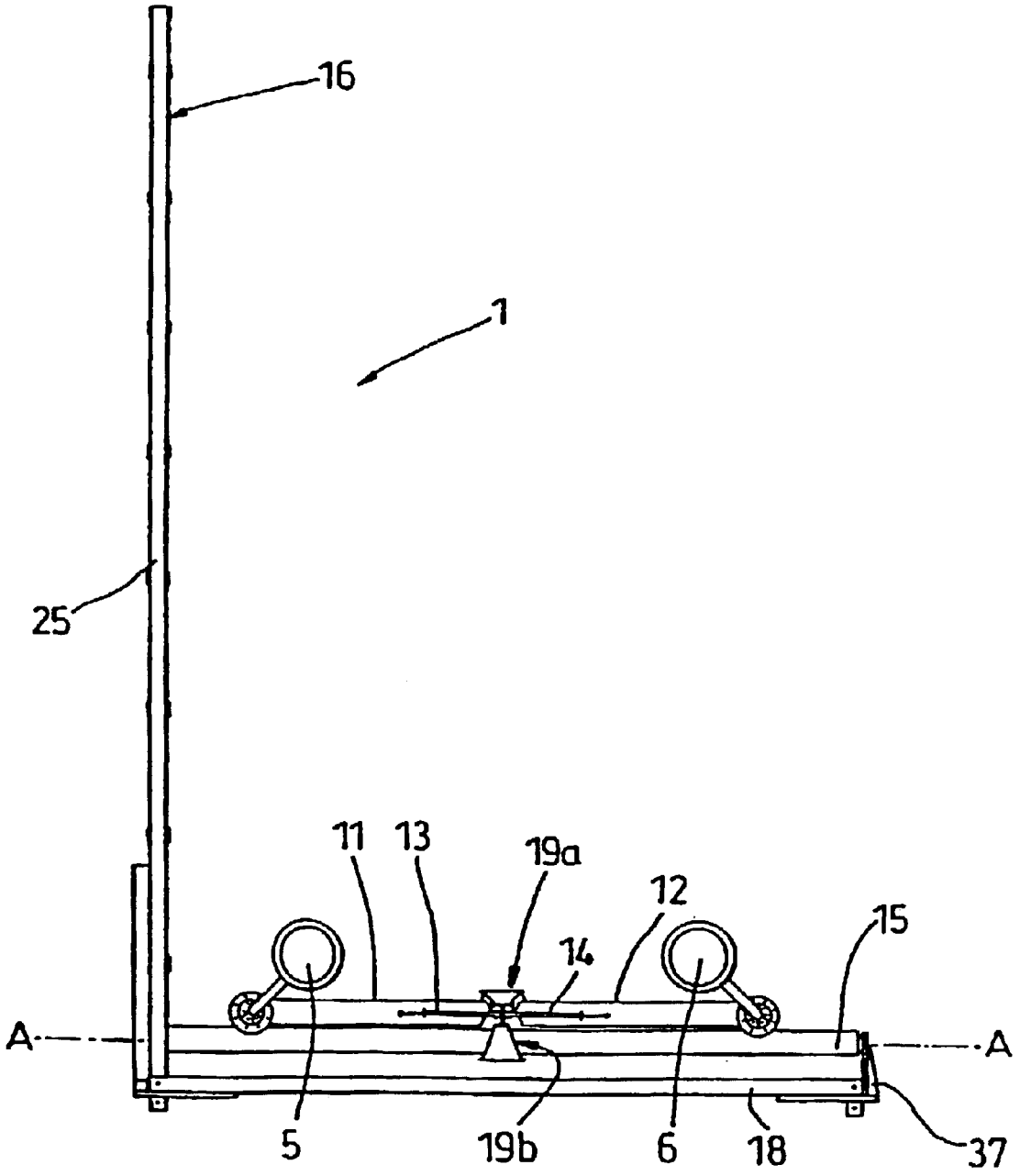
FIG. 3 is a front elevation of the assembly shown in FIGS. 1 and 2.

With reference to the figures, a marine vessel cleaning assembly 1 comprises, a pair of pivotable arms 3 and 4 which are each provided at their free ends with a rotatably mounted brush 5 and 6 respectively. The arms are pivotable about an axis A—A on an axle 15 which is mounted on a base framework 18, the arms being pivotable about axis A—A by means of an upright hydraulic ram 17*a* and a tie rod 17*b* which is connected to the ram 17*a*.

With reference in particular to FIG. 1, the arms 3 and 4 each comprise a central portion 27, 26 and two inwardly directed portions, 7 and 11, and 8 and 12 respectively. The adjacent inwardly directed arm portions 11 and 12 are connected to the distal end of the respective central portions 27 and 26 which are located towards (the axle 15. The arm portions 7 and 8 are located at the opposite distal ends of the central portions 27 and 26 respectively.

On each of the arm portions 7 and 8 there is mounted on gimbals 9 and 10 a brush 5 and 6, respectively. The gimbals provide free suspension in all planes for the respective brush. (It should be noted that for reasons of clarity the brushes are shown in a different orientation in the different Figures.) Each brush 5 and 6 comprises bristles provided on a front flat circular surface 30 and on a tapered outer surface 31. The brushes are provided with hydraulic drive means (not illustrated) which is operative to rotated the brushes. Flexible conduits (not shown) which carry the actuating hydraulic fluid are provided internally of the arms 3 and 4. Each arm 3 and 4 is pivotally mounted for generally lateral movement about pivots 21 and 20 in arcs C and D respectively.

The assembly 1 further comprises arm mounting means which comprises an upper limb 19*a* and a lower limb 19*b*. The limbs 19*a* and 19*b* extend generally longitudinally of the assembly 1. Hydraulic cylinder assemblies 13 and 14 are provided which are pivotally attached at one end to the arm portions 11 and 12 and at the opposite end to a bracket 35, the bracket 35 being secured between the free ends of the limbs 19*a* and 19*b*. The limbs 19*a* and 19*b* are fixedly secured to the axle 15, the pivots for said axle being provided on two upstanding brackets 36 and 37 which are attached to the base framework 18.

An operating arm 22 is attached at one end to the axle 15 and at its other end to the lower end of the tie rod 17*b*. The ram 17*a* and the tie rod 17*b* are enclosed by an upright framework 16 which comprises two opposing upright members 25 and a plurality horizontal bridges 24, each of which is attached to both upright members and ensures the rigidity of the upright framework 16. Inclined struts 23 and 25 are attached to a respective upright 25 and to the base framework 18.

Figure 4:
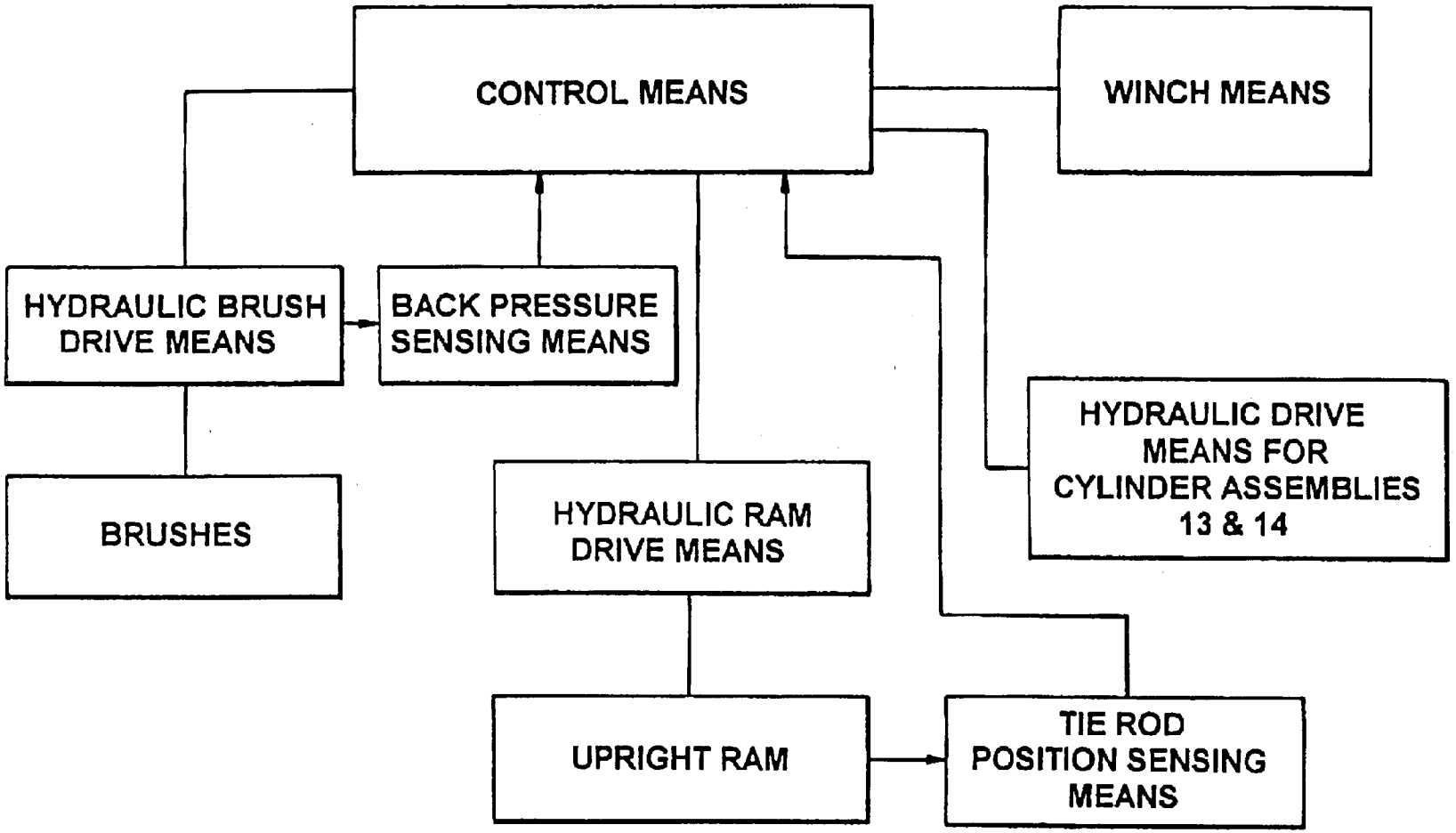
FIG. 4 is a block diagram of the control arrangement of the assembly shown in FIGS. 1, 2 and 3.

The operation the assembly 1 will now be described with reference to FIG. 4.

The assembly is submerged in a suitable region of water. The assembly 1 is attached to a mooring (not shown) and the base framework 18 rests on the seabed or, if the region of water is of substantial depth, the assembly, 1 may be secured to the mooring so that the base framework 11 is above the seabed. A marine vessel, for example a yacht (not shown), is then manoeuvred towards the assembly so that the vessel is positioned above the arms 3 and 4. A winch configuration (not shown) is then attached to a stern line and a bow line of the vessel so that the vessel may be conveyed across the axis A—A. The winch configuration is operative to convey the vessel in either a forwards or a backwards direction.

The tie rod 17*a* is then actuated by associated hydraulic drive means so that the arms 3 and 4 are pivoted upwardly about horizontal axis A—A towards the surface of the water. On reaching the surface of the water a signal is sent to memory means of the assembly control means by the user so that the vertical position of the tie rod 17*b* which corresponds to the arms being at the waterline is stored. Position sensing means is then operative to monitor the vertical position of the tie rod 17*b*. Using the control means, which comprises a console, a user then activates the hydraulic brush drive means so as to rotate the brushes 5 and 6. Hydraulic drive means associated with the hydraulic cylinder devices 13 and 14 is then activated so as to urge the arms 3 and 4 towards the hull of the vessel. Sensing means is provided which is operative to monitor the back pressure of the hydraulic fluid used to actuate the brushes.

Thus when the brushes come into contact with fouling on the hull, resistance to the rotation of the brushes will increase and the sensed back pressure of the hydraulic fluid of the brushes will increase accordingly as a result. The control means adjusts the hydraulic cylinder assemblies 13 and 14 so as to move the brushes towards or away from the hull so that a stored, predetermined value of the back pressure of the hydraulic driving fluid of the brushes is achieved. This predetermined back pressure value is such that an appropriate pressure is applied to the fouling and the hull by the brushes so that fouling is removed with the minimum of any hull paint.

Once the predetermined pressure value has been reached the cleaning operation is commenced and in so doing the hydraulic ram 17*a* causes the arms 3 and 4 to pivot downwardly about axis A—A. The correct pressure applied to the fouling on the hull is so maintained as the arms pivot about pivots 21 and 20 to follow the curved profile of the hull. The pivots 21 and 20 allow for displacement of the arms 3 and 4 which is generally lateral of the longitudinal axis the hull of the vessel. This is particularly advantageous since there is no requirement to initially align a vessel to the arms 3 and 4 but rather the arms will align to the position of the vessel. Moreover, the length of the arms 3 and 4 is such that only a relatively small force is required to pivot the arms about pivots 20 and 21, and given that the brushes are mounted on the gimbals 9 and 10, the assembly can allow for any side-to-side movement of the vessel caused by wave motion thus reducing the risk of damage being caused to the vessel as a result of such movement during the cleaning process.

As the arms sweep downwards through arc B, the rotating brushes eventually meet underneath the hull. When the brushes come into rotational contact with each other, the senses of rotation of the brushes are such that the sensed back pressure of the hydraulic brush drive means decreases. In response to this drop in back pressure the control means controls the hydraulic cylinder assemblies 13 and 14 to urge the arms 3 and 4 apart and generally outwardly of the hull. The control means then causes the winch means to be activated to convey the vessel a predetermined distance, typically equal to half the width of the brushes, perpendicular to the axis A—A. Whilst the brushes are still apart the arms are then pivoted generally upwardly of the hull through a predetermined angle by axle 15 and then towards the hull to contact with any fouling thereon. This step of pivoting the brushes outwardly, upwardly and then inwardly ensures that if the vessel has moved laterally during the time that the brushes are in rotating contact under the hull, the brushes can 'locate' the displaced vessel. Once the predetermined value of back pressure of the hydraulic brush drive means is attained, the brushes are pivoted generally upwardly of the hull.

Once the tie rod 17*b* aches the predetermined position corresponding to that angular position of the arms 3 and 4 at which the brushes are at water level, the arms 3 and 4 are urged laterally outwardly of the hull so that the brushes are no longer in contact therewith. The vessel is then moved forward the predetermined distance by the winch means. The arms are then urged laterally inwardly of the hull so that the brushes come into contact with the fouling with the required pressure. The brushes are then caused to sweep generally downwardly of the hull. The cleaning process continues in the same fashion until the whole length of the hull has been subjected to the brushes, at which point the winch means will have conveyed the vessel clear of the arcuate paths of the brushes.

It is important to note that the cleaning action of the rotating brushes is more suitably described as a wiping action rather that a scrubbing action. This is because the bristles of each brush are rolled against the fouling on the hull as opposed to using the tips of the bristles.

It will be appreciated that the assembly 1 may be adapted so that it is the assembly 1 which is conveyed with respect to a substantially stationary marine vessel.

The present invention offers many important advantages. Since a marine vessel may be cleaned whilst afloat, the significant financial costs associated with arranging for the vessel to remain on hard-standing are eliminated. Moreover, the time taken to clean a marine vessel using the inventive assembly is greatly reduced compared to that required when the vessel is taken out of the water to be cleaned by conventional methods. Since use of the inventive assembly can avoid the use of anti-fouling paints, the pollution introduced into the marine environment by such substances can be substantially reduced.

It will also be appreciated that whereas the cleaning means of the assembly comprises brushes, the cleaning means may comprise forced water or compressed air. Furthermore the brushes could be driven pneumatically or by a rotating motor.

During operation of the assembly the control means is operative to deactivate the hydraulic cylinder assemblies 13 and 14 and/or the hydraulic ram 17*a* if a predetermined pressure is exceeded in the assemblies 13 or 14 or the ram 17*a* respectively.

What is claimed is:

1. An apparatus for cleaning the hull of a floating vessel, the apparatus comprising a submersible framework, moveable cleaning means supported by the framework and displacement means for moving the cleaning means to clean the vessel hull, the displacement means being connected to the cleaning means and being operable for moving the cleaning means generally upwardly and downwardly with respect to said hull while cleaning the hull.

2. An apparatus for cleaning the hull of a floating vessel, the apparatus comprising a submersible framework, moveable cleaning means supported by the framework and motor driven displacement means for moving the cleaning means to clean the vessel hull, characterized in that the displacement means being connected to the cleaning means and being operable for moving the cleaning means generally upwardly and downwardly with respect to said hull while cleaning the hull.

3. An apparatus as claimed in claim 1 or 2 in which the apparatus comprises pivot means (17*a*, 17*b*, 15, 22) which is operative to pivot the cleaning means (5, 6), about a substantially horizontal axis (A—A), generally upwardly and downwardly of the hull.

4. An apparatus as claimed in claim 3 in which the pivot means (17*a*, 17*b*, 15, 22) is operative to pivot the cleaning means (5, 6) about an axis (A—A) which is submerged.

5. An apparatus as claimed in claim 1 or 2 in which the cleaning means (5, 6) comprises rotatably mounted brush means (5, 6) which, in use, is caused to rotate.

6. An apparatus as claimed in claim 5 in which the apparatus comprises sensing means which is operative to monitor a measure of the resistance to the rotation of the brush means (5, 6).

7. An apparatus as claimed in claim 5 in which the apparatus comprises control means which is operative to control the degree of generally upwardly and downwardly directed displacement of the brush means (5, 6).

8. An apparatus as claimed in claim 1 or 2 in which the apparatus comprises lateral displacement means (13, 14, 20, 21) which is operative to allow generally lateral displacement of the cleaning means (5, 6) with respect to the hull.

9. An apparatus as claimed in claim 1 or 2 in which the, apparatus comprises a pair of arms (3, 4), the cleaning means (5, 6) being mounted on the arms (3, 4).

10. A marine vessel cleaning assembly (1) as claimed in claim 9 in which the cleaning means (5, 6) is located towards one end of each arm (3, 4).

11. A marine vessel cleaning assembly (1) as claimed in claim 9 in which each arm (3, 4) is pivotable generally upwardly and downwardly of the hull.

12. A marine vessel cleaning assembly (1) as claimed in claim 9 in which each arm (3, 4) is pivotable generally laterally of the hull.

13. A vessel cleaning assembly (1) comprising cleaning means (5, 6) and displacement means (17*a*, 17*b*) supported on a framework (18) adapted for location under water, the arrangement being such that, in use, the displacement means is operative to urge the cleaning means (5, 6) generally upwardly and downwardly of a hull of a floating vessel, and the cleaning means is arranged to contact fouling on the hull wherein said cleaning means comprises rotatably mounted brush means which, in use, is caused to rotate and wherein the assembly further comprises sensing means which is operative to monitor a measure of the resistance to the rotation of the brush means.

14. A vessel cleaning assembly (1) comprising cleaning means (5, 6) and displacement means (17*a*, 17*b*) supported on a framework (18) adapted for location under water, the arrangement being such that, in use, the displacement means is operative to urge the cleaning means (5, 6) generally upwardly and downwardly of a hull of a floating vessel, and the cleaning means is arranged to contact fouling on the hull wherein said cleaning means comprises rotatably mounted brush means which, in use, is caused to rotate and wherein said assembly comprises control means which is operative to control the degree of generally upwardly and downwardly directed displacement of said brush means.

15. A method of cleaning the hull of a floating vessel comprising cleaning means and displacement means supported on a framework adapted for location under water, the arrangement being such that in use, the displacement means is operative to urge the cleaning means generally upwardly and downwardly of hull of a floating vessel and the cleaning means being arranged to contact fouling on the hull whereby control means are employed in carrying out said method to control the degree of generally upwardly and downwardly directed displacement of said cleaning means.

16. A method of cleaning the hull of a floating marine vessel comprising displacing cleaning means (5,6) generally upwardly and downwardly of the hull, and arranging that the cleaning means contacts with fouling on the hull, said cleaning means being pivoted generally upwardly and downwardly of the hull whereby relative translational movement of the hull with respect to the pivot axis (A—A) of the cleaning means (5,6) is brought about in which said cleaning means (5,6) is caused to rotate and in which the degree of generally upwardly and downwardly directed movement of the cleaning means (5,6) is controlled in response to a measured resistance to rotation of the cleaning means.

* * * * *